US005169302A

United States Patent [19]

Keller

[11] Patent Number: 5,169,302

[45] Date of Patent: Dec. 8, 1992

[54] BURNER

[75] Inventor: Jakob Keller, Dottikon, Switzerland

[73] Assignee: Asea Brown Boveri Ltd., Baden, Switzerland

[21] Appl. No.: 631,952

[22] Filed: Dec. 21, 1990

[30] Foreign Application Priority Data

Dec. 22, 1989 [CH] Switzerland ..... 4602/89

[51] Int. Cl.[5] ..... F23C 5/00

[52] U.S. Cl. ..... 431/173; 431/350; 431/351

[58] Field of Search ..... 431/2, 4, 8, 9, 10, 431/11, 12, 115, 116, 173, 182, 187, 188, 285, 278, 242, 239, 350, 351, 353; 60/39, 464, 743; 110/264, 347

[56] References Cited

U.S. PATENT DOCUMENTS 4,781,030 11/1988 Hellat et al. ..... 60/743
4,932,861 6/1990 Keller et al. ..... 431/284

FOREIGN PATENT DOCUMENTS 0321809 6/1989 European Pat. Off. .
2319846 2/1977 France .

*Primary Examiner*—Carl D. Price
*Attorney, Agent, or Firm*—Oblon, Spivak, McClelland, Maier & Neustadt

[57] ABSTRACT

A burner with a conical shape opening in the flow direction is composed of two partial-conical bodies, which are positioned one upon the other and whose centerlines in the longitudinal direction extend offset relative to one another. Because of this offset, a tangential inlet slot to an internal space of the burner is formed in each case over the length of the burner. The fuel supply takes place centrally via a nozzle and tangentially in the region of the inlet slots via, in each case, a fuel line, which is provided with fuel openings which there undertake the injection of the fuel. A duct is formed above each inlet slot and this is equipped with an injector. A further fuel is introduced through this injector. The air/fuel mixture with fuel from the injector and/or fuel from the fuel line flows generally as an air/fuel mixture through the tangential inlet slots into the internal space of the burner. If needed, further mixing with the fuel from the nozzle takes place there.

4 Claims, 2 Drawing Sheets

BURNER

BACKGROUND OF THE INVENTION

1. Field of the Invention

The present invention relates to a burner and as a method for operating such a burner.

2. Discussion of Background

A burner is known from EP-A1-0, 321,809 which consists of two half hollow partial-conical bodies which lie offset one upon the other. The conical shape of the partial-conical bodies shown in the figure of this patent extends in the flow direction at a certain fixed angle. The offset mentioned of the partial-conical bodies relative to one another creates a tangential inlet slot over the complete length of the burner on each of the two sides of the burner body, the width of the slot corresponding to the particular offset of the centerlines of the partial-conical bodies relative to one another and the combustion air flowing into the internal space of the burner through the slots.

A fuel nozzle is located in the internal space at the beginning of the burner and its fuel injection preferably emerges centrally between the centerlines of the partial-conical bodies offset relative to one another. Further fuel nozzles are provided in the region of the tangential inlet slots. Liquid fuel is preferably introduced through the central fuel nozzle whereas the fuel nozzles in the region of the tangential inlet slots are preferably operated with a gaseous fuel. If such a burner is operated with a medium calorific value gas, which usually contains easily ignited hydrogen, there exists the real danger that this gas and the combustion air introduced will mix so strongly even in the inlet region, at the location where they meet, in such a way that premature ignition of the mixture can occur. This would in turn lead to diffusion-type combustion with greatly increased $NO_x$ emission. In addition, it may also be the case that shear layers can easily occur with such air/gas mixing and the result of this is instability in the mixing process due to strong eddying. If gas supply pressure pulsations occur because of the above-mentioned instability, this additionally leads to strong vibrations in the system.

SUMMARY OF THE INVENTION

Accordingly, one object of this invention, is to provide, in a burner of the type mentioned, measures which make premature ignition of the mixture impossible when a medium calorific value gas is used as fuel. The measures should also permit stabilization of the mixing process.

The essential advantage of the invention may be seen in the fact that the $NO_x$ emissions remain low because no premature ignition occurs.

A further essential advantage of the invention may be seen in the fact that the injector, by which the objective is achieved, makes it possible to avoid substantial alteration to the flow field of the burner used despite the high mass flow proportion of the medium calorific value gas in the air/gas mixture. This is achieved by means of a suitable distribution of a number of injector holes of the same size or by means of an arrangement of holes whose diameter is varied in a suitable manner. The density of the gas inlet holes ($\rho_{GB}$) is proportional to the radially averaged combustion air inlet velocity through the tangential air inlet slots of the burner.

In addition, the injector in accordance with the invention does not permit the occurrence of shear layers during the mixing process. These shear layers, which always occur when the velocity of the gaseous fuel at the location of mixing is greater than the air velocity, cause strong eddies which initiate an instability of the system. Because the injector is designed in such a way that the two media meet at the mixing location with almost the same velocity, no turbulence occurs there; in addition, pressure pulsations which would have a negative effect on the mixing and combustion process do not occur at this location so that vibrations in the system are excluded. With respect to the flow velocity of the gaseous fuel, the mixing process is designed for full load and the gaseous fuel is "breathed" almost unpressurized into the airflow. Further advantages of the invention concern the avoidance of acoustic resonance in the injection of the fuel; because the gap width and the length of the injector are appropriately designed, the flow can recover to such an extent before leaving the injector that the acoustic resonance mentioned cannot occur.

A further advantage of the invention may be seen in the fact that combustion is conceivable over suitable temperature and pressure ranges even in the case of gases with a low calorific value.

Advantageous and desirable extensions of the way of achieving the objective, according to the invention, are claimed in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
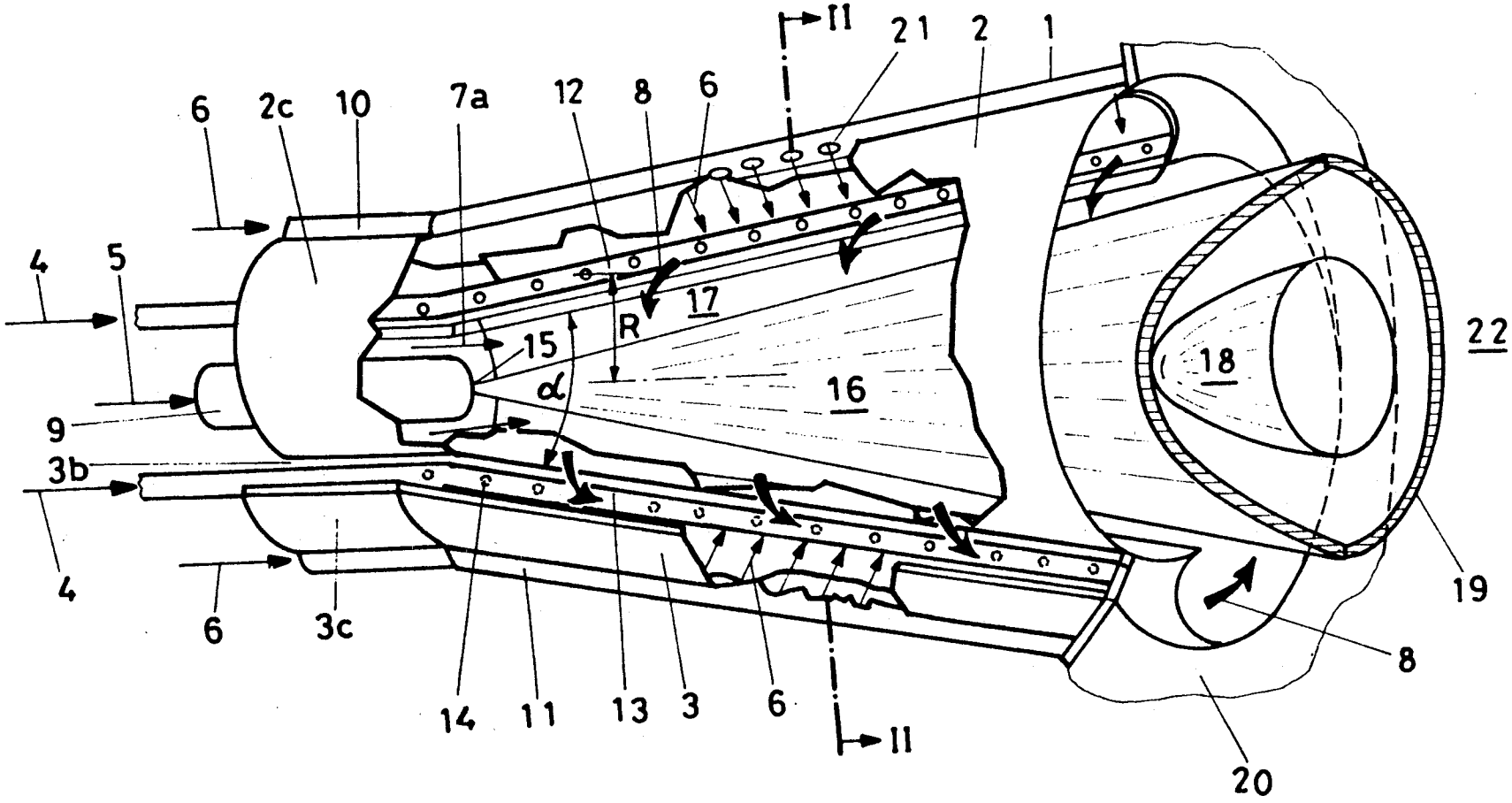
FIG. 1 shows a perspective representation of the burner, appropriately sectioned, with the tangential air supply indicated
Figure 2:
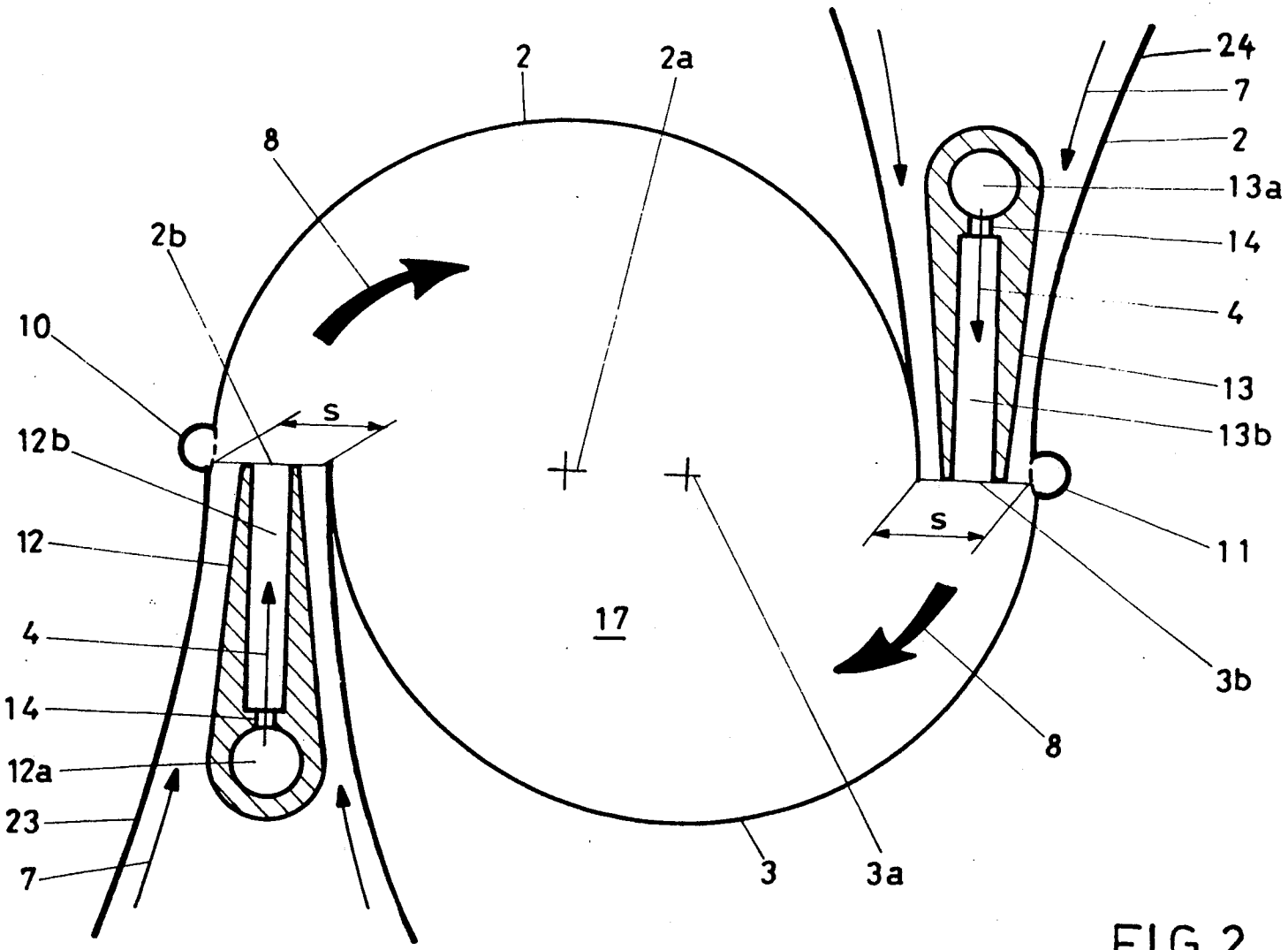
FIG. 2 shows a section through the plane II—II of FIG. 1, in a diagrammatic, simplified representation.

Referring now to the drawings, wherein like reference numerals designate identical or corresponding parts in the two views, the injectors shown in FIG. 2 are not included in FIG. 1 in order to make the latter more easily understood. FIG. 1 and FIG. 2 should be considered simultaneously in order to understand the structure of the burner better.

FIG. 1 shows a burner 1, which consists of two half hollow partial-conical bodies which lie one upon the other and offset relative to one another. The conical shape of the partial-conical bodies 2, 3 shown has a certain fixed angle in the flow direction. The partial-conical bodies 2, 3 can, of course, have an increasing conical inclination in the flow direction (convex shape) or a decreasing conical inclination in the flow direction (concave shape). The two latter shapes are not included in the drawing because they can be envisaged without difficulty. The shape which is finally used depends on the various parameters of the combustion process. The shape shown on the drawing is preferably used. The offset of the respective centerlines 2*a*, 3*a* (see FIG. 2) of the partial-conical bodies 2, 3 relative to one another creates a tangential inlet slot 2*b*, 3*b* in the flow direction on each of the two sides of the burner 1 with a certain free inlet slot width S (see FIG. 2) through which the combustion air 8 (air/fuel mixture) flows into the internal space 17 of the burner 1. The tangential inlet slot width S is a dimension which results from the offset of the two centerlines 2a, 3a of the partial-conical bodies 2, 3. The two partial-conical bodies 2, 3 each have an initial cylindrical portion 2c, 3c. These also extend offset relative to one another, in a manner analogous to the partial-conical bodies 2, 3, so that the tangential inlet slots 2b, 3b are present from the start. The burner 1 can, of course, describe a purely conical form, i.e. without an initial cylindrical body. A nozzle is located in this initial cylindrical body; this nozzle is preferably operated with a liquid fuel 5 and its fuel injection 15 is preferably located centrally between the two centerlines 2a, 3a. As a further fuel supply, both partial-conical bodies 2, 3 each have a fuel line 10, 11 which is provided in the flow direction with openings 21, which are distributed over the complete length of the fuel lines. A gaseous fuel 6 is preferably introduced through the fuel lines 10, 11, this fuel being injected in the region of the tangential inlet slots 2b, 3b as can be seen particularly well from FIG. 2. The burner 1 also has a fuel supply, preferably a supply of a gaseous fuel 4, which takes place via injectors 12, 13 which also act in the region of the tangential inlet slots 2b, 3b via a number of gas holes 14, as can be comprehensively seen from FIG. 2. Reference should be made to FIG. 2 for the relevant description. The burner 1 can, fundamentally, be operated by individual fuel supplies or in a mixed operation with the available fuel possibilities. At the combustion space end 22, the burner 1 has a collar-shaped wall 20 through which, if need be, holes are provided which are not shown and through which dilution air or cooling air is supplied to the front part of the combustion space 22. The liquid fuel 5 preferably introduced through the nozzle 9 into the burner 1 is injected at an acute angle into the internal space 17 in such a way that a conical spray pattern which is as homogeneous as possible appears at the burner outlet plane. This fuel injection 15 can involve air-supported atomization or pressure atomization. The conical liquid fuel profile 16 is surrounded by a tangentially entering combustion airflow 8 and an axially introduced further airflow 7a. The composition of the tangentially entering air/fuel mixture 8 is dealt with in more detail in the description of FIG. 2. The concentration of the liquid fuel 5 injected is continuously reduced in the axial direction of the burner 1 by an airflow or by the air/fuel mixture 8. If gaseous fuel 6 is introduced via the two fuel lines 10, 11, mixture formation with the air supply (not shown) (see. FIG. 2, item 7), commences directly in the region of the tangential inlet slots 2b, 3b because fuel openings 21 are provided there. In the case of the injection of liquid fuel 5 via the nozzle 9, the optimum, homogeneous fuel concentration over the cross-section is attained in the region where the vortex bursts, i.e. in the region where a reverse flow zone 18 forms. The combustion process for each air/fuel mixture then begins at the apex of this reverse flow zone 18. It is only at this point that a stable flame front 19 can occur. Burnback of the flame into the interior of the burner 1 (which is always to be feared in the case of known premixed sections and for which a remedy is provided in known sections by means of complicated flame holders) does not have to be feared in the present case. If, in general, the air used (see FIG. 2, Item 7) is preheated if the need arises, accelerated overall evaporation of the liquid fuel 5 takes place before the point at the outlet of the burner 1 is reached where the combustion process of the mixture commences. The degree of evaporation depends on the size of the burner 1, the droplet size and the temperature of the airflows 7a, 7 or of the air/fuel mixture 8. Independent of whether, in addition to the homogeneous droplet mixing by a combustion airflow of low temperature, either additional partial or complete droplet evaporation is achieved by preheated combustion air, the nitrogen oxide and carbon monoxide emissions are low if the excess air is at least 60%, so that in this case an additional means of minimizing the $NO_x$ emissions is available. The pollutant emission values are lowest in the case of complete evaporation of the fuel used before inlet into the combustion zone. The same also applies for near-stoichiometric operation if the excess air is replaced by recirculated combustion gas. Narrow limits have to be maintained in the design of the partial-conical bodies 2, 3 with respect to their cone angle and the width of the tangential inlet slots 2b, 3b so that the desired flow field of the air (with its reverse flow zone 18) occurs, for flame stabilization purposes, in the region of the mouth of the burner. In general, it should be stated that a reduction in the tangential inlet slots 2b, 3b, i.e. a reduction in the inlet width S (see FIG. 2), displaces the reverse flow zone 18 further upstream so that then, however, the mixture would ignite earlier. It should be noted that the reverse flow zone 18, once fixed geometrically, is intrinsically stable with respect to position because the swirl increases in the flow direction in the region of the conical shape of the burner 1. In addition, the axial velocity can be affected by axial supply of the airflow 7a already mentioned. The design of the burner 1 is extremely suitable for adapting—for a given installation length of the burner 1—the size of the tangential inlet slots 2b, 3b to the requirement by moving the partial-conical bodies 2, 3 towards or away from one another so that the distance between the two centerlines 2a, 3a is reduced or increased and the inlet slot width S also changes accordingly, as can be seen particularly well from FIG. 2. The partial-conical bodies 2, 3 can, of course, also be displaced relative to one another in a different plane. From this point of view, the burner 1 can be individually adapted without changing its combustion length.

FIG. 2 is a section approximately in the center of the burner 1, in accordance with the section plane II—II of FIG. 1. The axial-symmetrically arranged inlets 23, 24, which enter the internal space 17 of the burner 1, each contain an injector 12, 13 which extends over the whole length of the burner 1. The injector 12, 13 is designed in such a way that the preferably used gaseous fuel 4 flows out from a gas supply pipe 12a, 13a (through which flow is possible) via a number of gas holes 14 into a gas injector duct (blowing duct) 12b, 13b. The latter extends as far as the region of the tangential inlet slot 2b, 3b. The width of the injector 12, 13 is designed in such a way tha* the air introduced 7 flows along the flanks of the injector 12, 13 and starts to mix with the gaseous fuel 4 in the region of the tangential inlet slot 2b, 3b so that the air/fuel mixture 8 only appears then. The property of the injector 12, 13, that it hardly alters the flow field of the burner 1 despite the high mass-flow proportion of the medium calorific value gas used in the air/-gas mixture, is of fundamental importance. This is achieved with the aid of a suitable distribution of the gas holes 14 of equal magnitude or with the aid of an arrangement of holes whose diameter varies in a suitable manner. The density of the gas holes, referred to as $\rho_{GB}$, is then proportional to the radially averaged velocity of the air 7 in the inlet slots 2*b*, 3*b* of the burner 1, and is given by the following equation:

$$\rho GB \sim \ln\left\{\frac{\left(\frac{S}{\pi \cdot \sin\left(\frac{\alpha}{2}\right)}\right)^2 + \left(R + \frac{S}{2 \cdot \cos\left(\frac{\alpha}{2}\right)}\right)^2}{\left(\frac{S}{\pi \cdot \sin\left(\frac{\alpha}{2}\right)}\right)^2 + \left(R - \frac{S}{2 \cdot \cos\left(\frac{\alpha}{2}\right)}\right)^2}\right\}$$

where $\alpha$ is the included angle of the burner 1 (see FIG. 1), S indicates the inlet slot width and R is the average radius of the particular position considered in the inlet slot 2*b*, 3*b* (see FIG. 1). The directions of the gas holes 14 should preferably coincide with the prevalent flow direction in the inlet slot 2*b*, 3*b*. It is then important that the actual throttling of the gaseous fuel 4 takes place when entering the gas holes 14 from the gas supply duct 12*a*, 13*a*. Because medium calorific value gases generally contain easily ignitable hydrogen, the gas holes 14 are to be designed in such a way that they cannot blow freely into the internal space 17 of the burner 1. These gas holes 14 enter a gas injector duct 12*b*, 13*b* which extends as far as the inlet slot 2*b*, 3*b*. It is advantageous for this duct to be subdivided several times in the longitudinal direction by flow vanes (not visible) so that the gaseous fuel 4 is canalized in the direction of the combustion airflow under design conditions, for example full load. In addition, this helps permit the gaseous fuel 4 to be blown with the particular velocity of the air 7 introduced in the region of the inlet slots 2*b*, 3*b*. This prevents the air 7 and the medium value calorific gas 4 used from mixing strongly already in the inlet region of the internal space 17 of the burner 1 because this would necessarily lead to premature ignition which causes diffusion-type combustion with greatly increased $NO_x$ emissions. In order to achieve these desired objectives, the transition from the gas holes 14 to the subsequent gas injector duct 12*b*, 13*b* is preferably designed as a Borda-Carnot expansion. In terms of the minimum length of the gas injector duct, it is advantageous to employ the usual rule of 3–5 hydraulic diameters or 6–10 gap widths. Such a design ensures that the smoothed gas flow 4 can mix with the airflow 7 "as if breathed in" so that acoustic resonance is also avoided during the mixing process.

Obviously, numerous modifications and variations of the present invention are possible in light of the above teachings. It is therefore to be understood that within the scope of the appended claims, the invention may be practiced otherwise than as specifically described herein.

I claim:

1. A burner comprising:

(a) at least two partial-conical bodies positioned one upon the other and having a conical shape opening in a flow direction of the burner, each of said at least two partial-conical bodies having centerlines extending offset relative to one another in a longitudinal direction of said partial-conical bodies in such a way that tangential inlet slot means which lead to an internal space of the burner are formed over the length of the burner; and (b) duct means for providing an air flow, said duct means extending from the outside of said burner to the inlet slot means and comprising injector means for a fuel, wherein said injector means is located inside said duct means and the fuel flows out of the injector means in a region of the inlet slot means where the fuel is mixed with the air flowing through the duct means, said injector means comprising gas supply pipe means for supplying the fuel to the injector means, said gas supply pipe means extending in the flow direction of the burner and comprising a plurality of holes, said injector means further comprising injector channel means in said injector means which extend to the inlet slot means, said plurality of holes leading to the injector channel means, wherein said injector means, said plurality of holes and said injector channel means define a means for substantially equalizing a flow rate of the fuel and a flow rate of the air.

2. The burner as claimed in claim 1, wherein the transition from the holes to the subsequent injector channel means is formed by a Borda-Carnot expansion.

3. The burner as claimed in claim 1, wherein a density ($\rho_{GB}$) of the holes is proportional to a radially averaged inlet velocity of the air in a region of the inlet slot means of the burner, in accordance with the following equation:

$$\rho GB \sim \ln\left\{\frac{\left(\frac{S}{\pi \cdot \sin\left(\frac{\alpha}{2}\right)}\right)^2 + \left(R + \frac{S}{2 \cdot \cos\left(\frac{\alpha}{2}\right)}\right)^2}{\left(\frac{S}{\pi \cdot \sin\left(\frac{\alpha}{2}\right)}\right)^2 + \left(R - \frac{S}{2 \cdot \cos\left(\frac{\alpha}{2}\right)}\right)^2}\right\}$$

where $\alpha$ is the included angle of the conical burner, S signifies the inlet slot width and R is the average radius of the particular position considered of the inlet slot (2*b*, 3*b*).

4. The burner as claimed in claim 1, wherein the fuel through the injector means is a gaseous fuel and said means for substantially equalizing the flow rates of the fuel and air adjust an inlet velocity of the fuel into the internal space of the burner to be equal to or smaller than a velocity of the airflow, which mixes at least with the fuel in the region of the inlet slot means.

* * * * *